US005367147A

United States Patent [19]

Kim et al.

[11] Patent Number: 5,367,147

[45] Date of Patent: Nov. 22, 1994

[54] METHOD AND APPARATUS FOR CONTINUOUS MICROWAVE REGENERATION OF ADSORBENTS

[75] Inventors: Bang M. Kim, Schenectady; James J. Carroll, Sr., Ballston Lake; Donald E. Woodmansee, Schenectady, all of N.Y.

[73] Assignee: General Electric Company, Schenectady, N.Y.

[21] Appl. No.: 18,474

[22] Filed: Feb. 16, 1993

Related U.S. Application Data

[63] Continuation of Ser. No. 787,184, Nov. 4, 1991, abandoned.

[51] Int. Cl.[5] ..... H05B 6/78

[52] U.S. Cl. ..... 219/698; 219/700; 219/701; 432/244

[58] Field of Search ..... 219/10.55 A, 10.55 R, 219/10.55 F, 698, 700, 701; 432/59, 244

[56] References Cited

U.S. PATENT DOCUMENTS

| | | | |
|---|---|---|---|
| 3,624,335 | 11/1971 | Dench | 219/10.55 A |
| 3,718,082 | 2/1973 | LiPoma | 219/10.55 A |
| 3,731,036 | 5/1973 | Hallier et al. | 219/10.55 A |
| 4,204,979 | 5/1980 | Hobbs et al. | 252/416 |
| 4,257,783 | 3/1981 | Gutjahr et al. | 55/61 |
| 4,280,033 | 7/1981 | Wagener et al. | 219/10.55 A |
| 4,322,394 | 3/1982 | Mezey et al. | 423/244 |
| 4,349,714 | 9/1982 | Tamano | 219/10.55 A |
| 4,444,723 | 4/1984 | Matsumaru et al. | 219/10.55 A |
| 4,582,972 | 4/1986 | Curtin et al. | 219/388 |
| 4,640,020 | 2/1987 | Wear et al. | 219/10.55 R |
| 4,737,610 | 4/1988 | Kotsch et al. | 219/10.55 M |
| 4,746,968 | 5/1988 | Wear et al. | 219/10.55 F |
| 4,789,332 | 12/1988 | Ramsey et al. | 432/59 |
| 5,227,598 | 7/1993 | Woodmansee et al. | 219/10.55 R |

*Primary Examiner*—Bruce A. Reynolds
*Assistant Examiner*—Tu Hoang
*Attorney, Agent, or Firm*—Patrick R. Scanlon; Paul R. Webb, II

[57] ABSTRACT

Apparatus and method for regenerating saturated adsorbents using microwave energy. A saturated adsorbent, such as activated carbon, is fed onto a continuously moving conveyor belt. The conveyor belt transports the carbon to a microwave cavity where the carbon is exposed to microwave energy. The cavity is defined by a containment enclosure which is sealed to prevent radiation leakage. The carbon is heated to a sufficient temperature to cause the contaminants to desorb. The system also includes vents for removing the desorbed contaminants and a holder for receiving the treated carbon discharged from the belt. The microwave cavity may be divided into a number of heating compartments so that the carbon on the belt is heated to different temperatures in each compartment. Each compartment is separately vented, thereby allowing selective recovery of the different contaminants in the carbon.

16 Claims, 2 Drawing Sheets

METHOD AND APPARATUS FOR CONTINUOUS MICROWAVE REGENERATION OF ADSORBENTS

This application is a continuation of application Ser. No. 07/787,184, filed Nov. 4, 1991, now abandoned.

BACKGROUND OF THE INVENTION

This invention relates generally to the continuous regeneration of an adsorbent such as activated carbon using microwave energy and more particularly concerns a method and apparatus in which sorbated adsorbent material is conveyed through a microwave cavity via a moving belt wherein the adsorbent is heated to strip the sorbates therefrom.

In industry, process streams carrying contaminants or other components are often purified by passing the stream in contact with an adsorbent. The contaminants or other components are adsorbed by the adsorbent, thereby removing them from the process stream. These adsorbed materials are referred to as adsorbates or simply sorbates. Thus, the term sorbated adsorbent refers to an adsorbent having adsorbed materials therein. In the course of cleansing process streams, the adsorbent will eventually become saturated with sorbates and be unable to adsorb further materials. Rather than simply being disposed of, a saturated adsorbent can be recycled through a process which desorbs or strips the sorbates from the adsorbent. Once the sorbates have been desorbed, the adsorbent is again capable of being used to cleanse process streams.

Such processes are generally referred to as regeneration because they renew or regenerate the adsorbing capacity of the treated adsorbent. In the case where the adsorbent is activated carbon, a distinction is made sometimes where low temperature processes (i.e., in the range of 200°–400 ° F.) are referred to as regeneration and higher temperature processes (up to 1800° F.) are referred to as reactivation. However, for the sake of clarity, the term "regeneration" as used herein, will include both low and high temperature desorbing processes. It is desirable to employ a regeneration process which is capable of stripping the sorbates on the plant site, thereby eliminating the need to ship the sorbated carbon off site for cleaning. Besides offering cost advantages, on site regeneration reduces the number of plant emissions which must be reported to the Environmental Protection Agency.

A typical method of regenerating a saturated adsorbent is to heat the adsorbent with a flow of hot gas such as steam or flue gases to a sufficiently high temperature at which the sorbate will be desorbed. The high temperature causes the sorbated matter to vaporize and pass from the adsorbent. The flow of the hot gas also purges the vaporized or desorbed materials from the system. This gas heating method has the problems of long regeneration times, low heating efficiency, requiring large amounts of purge gas, diluting the sorbate vapors with heating gases, and often generating resulting sorbate condensates containing a large fraction of water.

To avoid many of the problems associated with the hot gas heating method, microwave heating of the adsorbents such as activated carbon has been proposed. A simple approach to microwave heating is to place the carbon adsorbent into a bulk container and expose the container to microwave energy in order to heat the adsorbent to the regeneration temperature. However, this approach is still very inefficient and time consuming because it is a non-continuous or batch operation, wherein only relatively small amounts of adsorbent material can be regenerated during a cycle. This approach also presents difficulty in charging and discharging carbon in and out of the container, can experience agglomeration of carbon granules when treating carbon containing water, dirt and/or other solids, provides slow heating of the center of the carbon bed due to the limited penetration depth of the microwaves, and experiences heavy attrition of carbon due to excessive rough handling during loading and unloading.

One solution to the problem of batch operation is set forth in U.S. Pat. No. 4,737,610 to Kotsch et al. The Kotsch et al patent discloses a method and apparatus using a gravity-driven moving bed for the desorption of noxious materials from a carbonaceous adsorption agent. Saturated carbon or coke is fed into the regeneration unit via a dosing and closure unit 1. The coke falls into a quartz conduit 2 where it is heated by a microwave heating means. The coke then enters a desorption gas collector 6 where it builds up a free fill above a perforated conical plate 7. In the desorption gas collector 6, the coke is swept with an inert gas to apparently remove the desorbed noxious materials. In a second embodiment, the quartz conduit is replaced with a horizontal moving belt which conveys coke through a heating chamber prior to dumping the coke into the desorption gas collector 6 by gravity feed. While the Kotsch et al patent does not use a batch operation, it still faces the other operating problems mentioned above. Due to the free fall method of moving the carbon, there is a high degree of relative movement between the carbon granules and between the carbon granules and the walls of the container. This relative movement, tends to grind the carbon into smaller, less useful particles, thus producing attrition losses. The carbon is especially susceptible to attrition at the high temperatures involved with regeneration. The free falling carbon is also susceptible to agglomeration of granules when containing water, dirt and/or other solids. Furthermore, the universal desorption gas collector 6 is unable to selectivity recover the desorbed noxious materials.

SUMMARY OF THE INVENTION

Accordingly, it is an object of the present invention to provide a method and apparatus for regenerating activated carbon and other adsorbents which overcomes the above-mentioned problems.

More specifically, it is an object of the present invention to provide a method and apparatus for regenerating adsorbents which is a continuous operation, is able to handle adsorbent materials containing water and other solids without agglomeration, has high energy efficiency, and has low adsorbent attrition losses.

In addition, it is an object of the present invention to provide a method and apparatus for regenerating adsorbents which can selectively recover desorbed contaminants.

These and other objects are accomplished in the present invention by providing an apparatus for regenerating sorbated adsorbents having a microwave cavity with microwave heating means disposed therein. An endless conveyor belt or a series of linked trays is arranged to carry a sorbated adsorbent such as contaminated activated carbon through the cavity, so as to expose the carbon to microwave energy. The cavity is defined by a containment enclosure which is sealed to prevent radiation leakage. The enclosure includes a central chamber where the microwave heating is carried out and two narrow ducts extending from opposite sides of the central chamber. Adsorbent is deposited on the conveyor belt in at distal end of a first duct, passes through the central chamber, and is discharged from the belt at the distal end of the other duct. The device also includes vent means for removing desorbed materials and a holder for receiving the treated carbon discharged from the belt. The central chamber may be divided into a number of heating compartments so that the carbon on the belt is heated to different temperatures in each compartment. Each compartment is separately vented, thereby allowing selective recovery of the different sorbates from the carbon by their temperature of evolution. This process reduces downstream separation costs.

The method of operation comprises placing sorbated carbon onto the continuously running conveyor belt in the form of a shallow bed. The shallowness of the bed insures rapid and uniform heating by the microwaves. The carbon is conveyed into the central chamber where it is heated to a temperature sufficient to desorb the contaminants. The desorbed contaminants are removed by sweeping the enclosure with a purge gas. The desorbed carbon is collected as it is discharged from the belt. In the case where the central chamber is divided into a number of heating compartments, the carbon is heated to a different temperature in each compartment to selectively recover the desorbed materials.

Other objects and advantages of the present invention will become apparent upon reading the following detailed description and the appended claims and upon reference to the accompanying drawings.

DESCRIPTION OF THE DRAWINGS

The subject matter which is regarded as the invention is particularly pointed out and distinctly claimed in the concluding portion of the specification. The invention, however, may be best understood by reference to the following description taken in conjunction with the accompanying drawing figures in which:

DETAILED DESCRIPTION OF THE INVENTION

The present invention can be used with any adsorbent which is capable of being safely heated with microwaves. One preferred adsorbent material is activated carbon. Activated carbon is an amorphous form of carbon which is treated to have a very large surface area. This large surface area means there is a high internal porosity which provides high adsorptiveness of gases and vapors from gases and dissolved substances from liquids. Thus, while the following description refers to activated carbon as the preferred adsorbent, the present invention is not intended to be limited to this one material.

Figure 1:
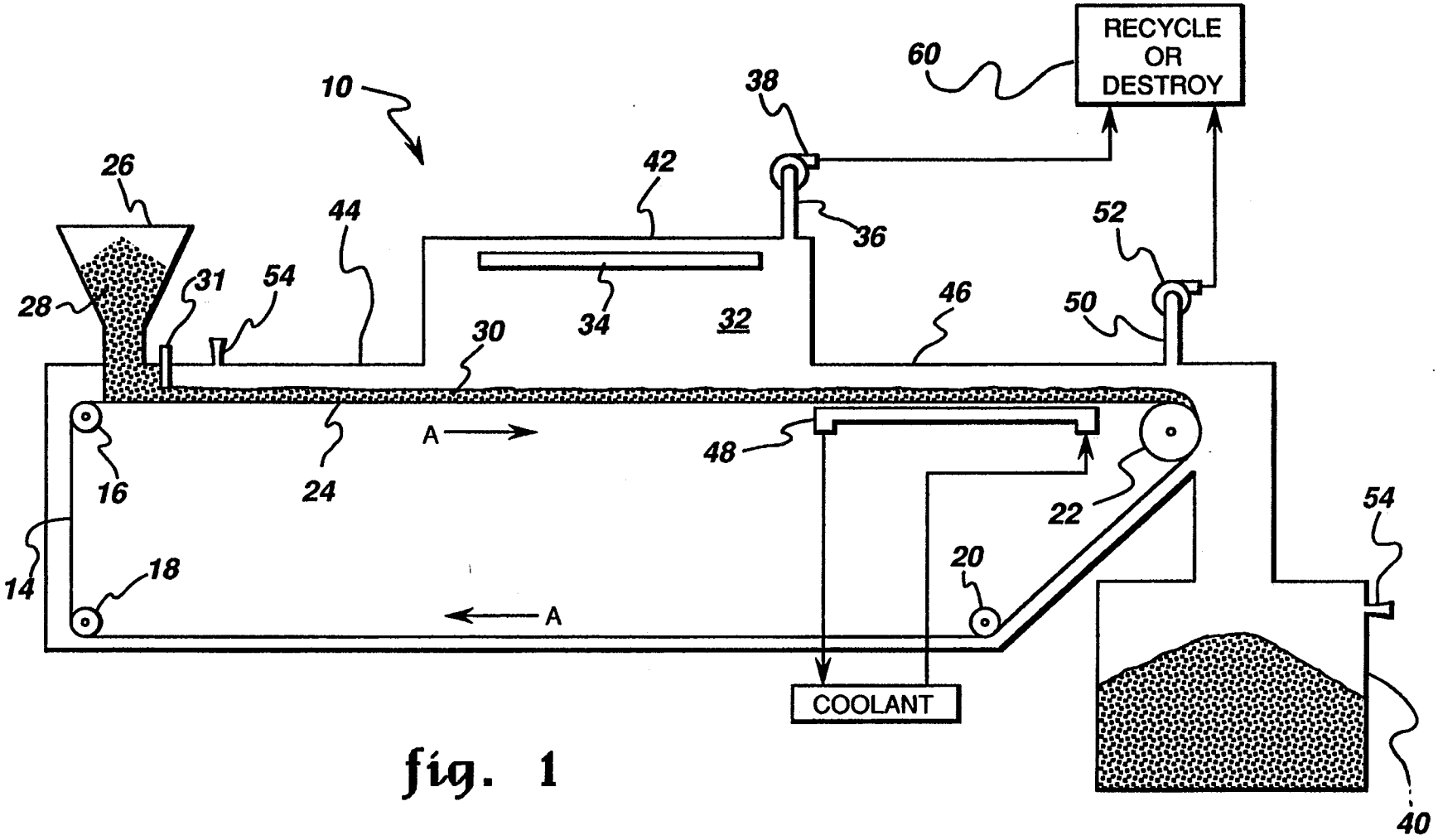
FIG. 1 is a cross sectional view of a first embodiment of the present invention.

Turning now to FIG. 1, the regeneration unit 10 of the present invention is shown. The regeneration unit comprises an enclosure 12 in which the regeneration process is performed. An endless conveyor belt 14 is completely disposed within the enclosure 12. The conveyor belt 14 is disposed on a number of pulleys or rollers 16,18,20 and is engaged by a drive pulley 22 associated with a drive motor (not shown) which drives the belt 14 in the direction indicated by the arrows A. The drive motor can be controlled to adjust the belt speed. The portion of the belt 14 extending between the upper left pulley 16 and the drive pulley 22 defines a horizontal conveyance path 24. The belt 14 is made of a material capable of withstanding high temperatures. Preferred materials are ceramics, metal sheeting or a high temperature polymer such as the polymer sold under the trademark Nomex.

Figure 1A:
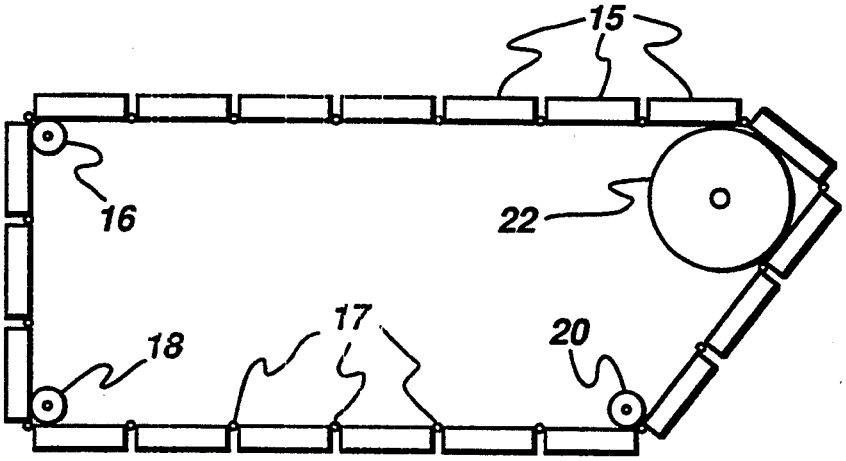
FIG. 1A is a partial view of a variation of the embodiment of FIG. 1.

FIG. 1A shows an alternative conveyance means to the flat belt 14 of FIG. 1. A series of ceramic trays 15 are arranged in an endless chain over the pulleys 16,18,20,22. Adjacent trays are connected together with pivotable links 17 to form the closed loop.

A feed hopper 26, formed in the enclosure 12 near the first end, holds a supply of spent, saturated adsorbent material 28 such as activated carbon. The carbon 28 is fed from the feed hopper 26 into the enclosure 12 and onto the conveyance path 24 of the belt 14. The carbon 28 is deposited on the belt 14 in the form of a shallow bed 30 approximately 1–3 inches deep. An adjustable dam 31 is provided in the top wall of the enclosure 12, just downstream of the feed hopper 26. The height of the dam above the belt 14 is adjustable in order to vary the depth of the bed 30. The bed of carbon 30 is transported along the conveyance path 24 into a microwave cavity 32 formed in the enclosure 12. A microwave heating device 34 is disposed within the microwave cavity 32. The microwave heating device 34 subjects carbon in the microwave cavity 32 to electromagnetic radiation, thereby heating the carbon for regeneration. A vent 36 is provided in the microwave cavity 32. An eductor fan 38 is connected to the vent 36 for removing desorbed materials through the vent. The cavity 32 is maintained slightly below atmospheric pressure, and an inert gas such as nitrogen is employed to prevent air from contacting the heated carbon.

The microwave heating device 34 can be embodied as any one of the many standard arrangements known in the art. For instance, the microwave heating device 34 could be a microwave antenna coupled to a microwave emitter or one or more magnetrons connected to the microwave cavity 32 by waveguides. In the second case, the magnetron must be sealed from the vapor in the microwave cavity. This can be accomplished by placing a seal in the waveguide. The seal would be made from a plastic material which passes microwave radiation but is impervious to the vapors. Examples of such materials are Teflon resins and polypropylene. The device will operate at one of the frequencies assigned by the Federal Communications Commission for such uses. The most typical frequencies are 0.915 GHz and 2.45 GHz. The power required by the microwave heating device 34 will depend on the particular application. The power level will have to be sufficient to heat the volume of carbon in the microwave cavity 32 in the time the carbon is in the cavity 32. Of course, the time in the cavity is dependent on the speed of the belt 14.

The conveyor belt 14 transports the carbon bed 30 out of the microwave cavity 32 and further along the conveyance path 24. At the end of the conveyance path 24, the conveyor belt 14 curves around the drive pulley 22. Thus, the carbon on the belt 14 is discharged from the belt 14 at this point. The falling carbon is collected in a storage bin 40 situated below this drop off point.

The regenerated carbon held in the storage bin 40 is ready to be reused.

The enclosure 12 is a sealed, thermally insulated steel containment which prevents leakage of electromagnetic radiation and contains heat and gases therein. The enclosure 12 comprises three primary sections: a central chamber 42 which defines the microwave cavity 32, a first duct 44, and a second duct 46. The first duct 44 has an open end connected to one side of the central chamber 42 so that the duct 44 is in communication with the interior of the chamber 42. Likewise, the second duct 46 has an open end connected to an opposite side of the central chamber 42 and is in communication with the chamber interior. Both ducts extend outwardly to closed distal ends. The ducts 44,46 are configured as long, relatively narrow ducts in order to "choke" electromagnetic radiation passage. The feed hopper 26 is integrally attached to the first duct 44 near its distal end. Similarly, the storage bin 40 is integrally attached to the distal end of the second duct 46.

The carbon collected in the storage bin 40 can be collected while it is still hot from the microwave heating or it can be cooled prior to collection. In order to cool the carbon, a cooling unit 48 is provided in the second duct 46 to cool the regenerated carbon passing therethrough. Although any type of cooling means can be used, the cooling unit 48 as shown in FIG. 1 is an elongated heat exchanger disposed adjacent to the conveyor belt 14. A coolant is introduced in one end of the heat exchanger and exits from the other, absorbing heat from the carbon as it passes through. A secondary vent 50, provided with a eductor fan 52, is situated at the distal end of the second duct 46. While the bulk of the desorbed materials are removed via the first vent 36, some of these materials may be missed. The secondary vent 50 provides a means for removing the residual materials in the system. The enclosure 12 is swept with a purge gas to facilitate removal of the desorbed materials. The purge gas is introduced into the enclosure 12 via two inlets 54. One of the inlets 54 is located in the first duct 44 near the feed hopper 26. The other inlet is located in the storage bin 40. Using an inert gas such as nitrogen or oxygen depleted air as the purge gas will prevent oxidation of the carbon.

The moving belt system of the present invention provides many advantages. For one, conveying the carbon on a moving belt greatly reduces the relative movement between carbon particles, particularly in the high temperature area of the microwave cavity 32 where relative movement is virtually nonexistent. This means that carbon loss due to attrition is greatly reduced. The moving belt also allows continuous operation and easy handling of carbon containing water and dirt. The shallowness of the carbon bed means that the carbon will be heated quickly thus assuring that the contaminants will desorb at a fast rate. It is possible to heat powdered carbon as well as granular carbon on the belt system.

In operation, the motor of drive pulley 22 is activated to continuously move the conveyor belt 14 in the direction shown by the arrows A. The belt speed is adjusted to the desired value. The eductor fans 38 and 52 are activated and purge gas is admitted into the enclosure 12 through the inlets 54. Saturated adsorbent from the feed hopper 26 is fed onto the continuously moving conveyor belt 14. The carbon is fed in the form of a shallow bed about 1–3 inches deep. The depth of the bed can be controlled by adjusting the height of the dam 31. The belt 14 transports the carbon to the microwave cavity 32 where it is heated to a temperature sufficient to desorb the contaminants or sorbates. The sufficient temperature level is dependent on the boiling points of the sorbates and the affinity of the sorbates to the carbon. The carbon must be raised to a temperature at which all sorbates will vaporize. The temperature to which the microwave heating device 34 will heat the carbon is a function of the power of the microwave heating device 34, the volume of carbon, and the time the carbon is in the cavity 32. The volume of carbon is a function of the depth and width of the carbon bed; the time in the cavity is a function of the belt speed and the length of the cavity 32 along the direction of belt travel. Thus, all of the operating parameters the heating power, the bed depth and the belt speed must be balanced to achieve the proper temperature. Ideally, the system should be able to heat the adsorbent to a temperature in the range of approximately 200° F. to 1800° F.

The desorbed materials are removed through the vent 36 by the eductor fan 38. As indicated schematically in block 60, the removed vapors can either be recovered for recycle or destroyed, depending on their relative uses. In the case of recovery, the vapors would be condensed in a condenser system and collected for future use. Destruction could be accomplished with a vapor incinerator.

The carbon bed 30, stripped of the bulk of the sorbates, is conveyed out of the microwave cavity 32 and through the second duct 46. The carbon is optionally cooled in the duct 46 by the cooling unit 48. Any residual desorbed materials are removed through the secondary vent 50. These materials are either recovered or destroyed in the same fashion discussed above for the materials removed through the first vent 36. At the end of the belt, the clean carbon is dumped into the storage bin 40 where it is ready for future use.

Figure 2:
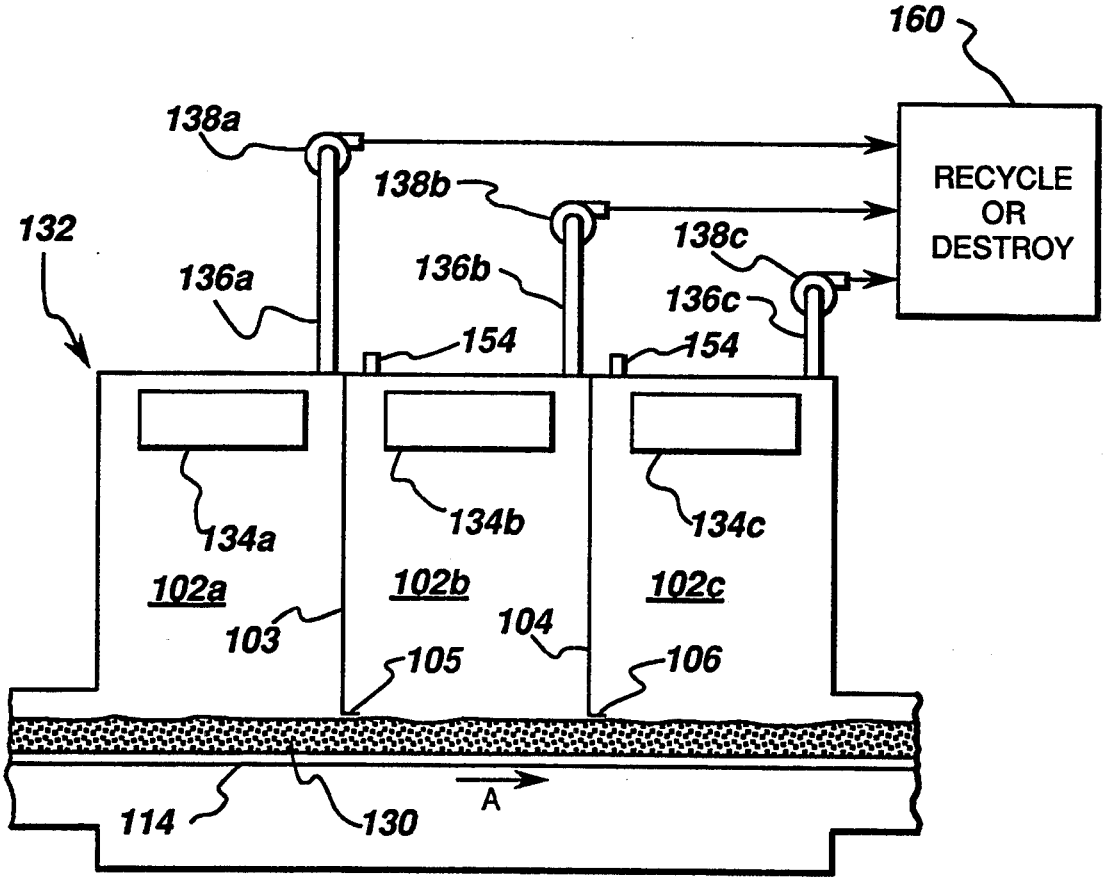
FIG. 2 is a fragmentary cross sectional view of a second embodiment of the present invention.

Turning to FIG. 2, a second embodiment of the present invention is illustrated. FIG. 2 shows a microwave cavity 132 of a regeneration unit 100 which, except for the microwave cavity 132 and the structure therein, is identical to the regeneration unit 10 of FIG. 1. Thus, the microwave cavity 132 is part of a larger enclosure which is not entirely shown in FIG. 2.

As seen in the Figure, the microwave cavity 132 is divided into three separate compartments **102*a*, 102*b*, 102*c*. Although three compartments are shown in the Figure, it will be seen that any number of compartments are applicable to this embodiment of the present invention. Each compartment is provided with a respective microwave heating device 134*a*, 134*b*, 134*c* for heating the contents of the corresponding compartment. The microwave heating devices 134*a–c* operate individually in order to heat each corresponding compartment 102*a–c* to a different temperature. A vent 136*a*, 136*b*, 136*c* is provided in each compartment and an eductor fan 138*a*, 138*b*, 138*c* is associated with each one of the vents for removing desorbed materials through the vents. Additional inlets 154 are provided for admitting purge gas into the second and third compartments 102*b*, 102*c*. An endless conveyor belt 114 is arranged to pass through the microwave cavity 132. The conveyor belt 114 is driven by a drive motor (not shown) in the direction of the arrow A. The belt 114 carries a shallow bed of adsorbent material 130**, such as activated carbon, through the microwave cavity.

The separate compartments are defined by a pair of dividing walls 103,104 which extend from the upper interior surface of the microwave cavity down to a point at or just above the surface of the carbon bed 130. By being in such proximity to the carbon bed surface, the dividing walls 103,104 form rough seals 105,106 between adjacent compartments. The seals 105,106 are configured as lips or flanges extending in a downstream direction and at a right angle from the bottoms of the dividing walls 103,104. Although not perfect, the seals 105,106 substantially prevent passage of vapors between adjacent compartments.

The compartmentalization of the microwave cavity 132 allows for the separation of the desorbed gases as they are evolved from the adsorbent. Because of the ability of microwaves to penetrate the carbon bed, heating with microwaves provides a generally uniform temperature across the bed at any axial point along the direction of travel. By using the individual microwave heating means 134*a–c* to heat the carbon in the three compartments 102*a–c* to different temperatures, the present invention is able to desorb different sorbates in each of the compartments. Since each compartment has its own venting arrangement, the sorbates can be selectively collected for recycle or destruction as represented by block 160. For example, the operating parameters (e.g., belt speed, heating power, bed size, etc.) could be set up so that the carbon is heated to about 41° C. in the first compartment 102*a*, 100 ° C. in the middle compartment 102*b*, and 153° C. in the last compartment 102*c*. This arrangement would allow the collection of methylene chloride (boiling point 41° C.) in the first compartment 102*a*, water (boiling point 100° C.) in the middle compartment 102*b*, and cumene (boiling point 153° C.) in the last compartment 102*c*. This example shows how the present invention can be used to selectively collect three different materials. However, the microwave cavity can be compartmentalized to whatever degree desired.

The foregoing has described a method and apparatus for regenerating saturated adsorbents in a continuous operation with low attrition losses and high energy efficiency, and which is able to handle adsorbents containing water and dirt. In addition, the method and apparatus present invention can selectively recover the different sorbates found in the adsorbent.

While specific embodiments of the present invention have been described, it will be apparent to those skilled in the art that various modifications thereto can be made without departing from the spirit and scope of the invention as defined in the appended claims.

What is claimed is:

1. An apparatus for regenerating a sorbated adsorbent comprising:

a heating cavity;

a conveyor belt arranged to pass through said cavity;

a microwave heating device disposed in said cavity for heating said sorbated adsorbent in said cavity to a temperature at which sorbates in said adsorbent are desorbed;

intake means for admitting purge gas into said cavity;

a vent formed in said cavity for removing desorbed materials from said cavity; and means for receiving adsorbent being discharged from said conveyor belt.

2. The apparatus of claim 1 further including an enclosure which comprises a central chamber that defines said cavity, a first duct extending from one side of said central chamber to a closed distal end, and a second duct extending from another side of said central chamber to a closed distal end, said conveyor belt extending from said first duct, through said central chamber, and into said second duct.

3. The apparatus of claim 2 wherein said receiving means is connected to said second duct near its distal end.

4. The apparatus of claim 3 further comprising adsorbent inlet means for feeding adsorbent to be treated onto said conveyor belt, said adsorbent inlet means being located near the distal end of said first duct.

5. The apparatus of claim 2 further including a cooling means located adjacent to said conveyor belt in said second duct.

6. The apparatus of claim 4 wherein said intake means comprises a first inlet located in said first duct near said adsorbent inlet means and a second inlet located in said receiving means.

7. The apparatus of claim 1 further comprising a fan connected to said vent.

8. The apparatus of claim 1 wherein said conveyor belt is made of a material selected from the group including ceramics, metal sheeting and high temperature polymers.

9. The apparatus of claim 1 wherein said conveyor belt comprises a series of linked trays.

10. An apparatus for regenerating a sorbated adsorbent comprising:

a first heating cavity;

a second heating cavity;

a conveyor belt arranged to pass through said first and second heating cavities;

a first microwave heating device disposed in said first heating cavity for heating an adsorbent to a temperature at which sorbates in said adsorbent are desorbed;

a second microwave heating device disposed in said second heating cavity for heating an adsorbent to a higher temperature at which other sorbates in said adsorbent are desorbed;

a first vent formed in said first heating cavity;

a second vent formed in said second heating cavity; wherein said first and second vents are for removing desorbed materials from said first and second cavities, and means for receiving adsorbent discharged from said conveyor belt.

11. The apparatus of claim 10 further comprising:

a third heating cavity, said conveyor belt being arranged to pass through said third heating cavity;

a third microwave heating device disposed in said third heating cavity for heating an adsorbent to a third temperature at which more sorbates in said adsorbent are desorbed; and a third vent formed in said third heating cavity for removing additional desorbed material.

12. A method of regenerating sorbated adsorbents comprising the steps of:

placing sorbated adsorbent onto a continuously moving conveyor belt;

conveying said sorbated adsorbent on said conveyor belt through a microwave heating cavity having a microwave heating device disposed therein;

heating said sorbated adsorbent with microwave energy to a temperature sufficient to desorb sorbates in said adsorbent;

sweeping said microwave heating cavity with a purge gas;

removing desorbed materials from said microwave heating cavity through a vent formed in said cavity; and collecting adsorbent which is conveyed out of said microwave heating cavity.

13. The method of claim 12 wherein said step of removing desorbed materials comprises providing a vent in said microwave heating cavity and drawing desorbed materials through said vent.

14. The method of claim 12 wherein said step of heating said sorbated adsorbent comprises heating said sorbated adsorbent to different temperatures in separate compartments within said microwave heating cavity, thereby sequentially desorbing different sorbates.

15. The method of claim 12 wherein said step of placing a sorbated adsorbent onto a continuously moving conveyor belt comprises placing said adsorbent in a bed 1–3 inches deep.

16. The method of claim 14 wherein said step of removing desorbed materials comprises providing a vent in each of said compartments and drawing desorbed material in each compartment through the respective vent.

* * * * *